US006365850B1

(12) United States Patent
Arnold et al.

(10) Patent No.: US 6,365,850 B1
(45) Date of Patent: Apr. 2, 2002

(54) SWITCH ASSEMBLIES

(75) Inventors: Aaron Anthony Arnold, Leigh; Geoffrey Alan Talbot, Wigan; Mehdi Mohtasham, Manchester, all of (GB)

(73) Assignee: EJA Engineering Limited, Wigan (GB)

( * ) Notice: Subject to any disclaimer, the term of this patent is extended or adjusted under 35 U.S.C. 154(b) by 0 days.

(21) Appl. No.: 09/077,210

(22) PCT Filed: Nov. 27, 1996

(86) PCT No.: PCT/GB96/02928

§ 371 Date: Jun. 16, 2000

§ 102(e) Date: Jun. 16, 2000

(87) PCT Pub. No.: WO97/20334

PCT Pub. Date: Jun. 5, 1997

(Under 37 CFR 1.47)

(30) Foreign Application Priority Data

Nov. 28, 1995 (GB) ..... 9524297

(51) Int. Cl.[7] ..... H01H 3/02; H01H 27/00; H01H 3/42

(52) U.S. Cl. ..... 200/17 R; 200/574

(58) Field of Search ..... 200/17 R, 520–574, 200/329–332.2, 61.18

(56) References Cited

U.S. PATENT DOCUMENTS 3,383,485 A * 5/1968 Nadzam et al. ..... 200/574
3,746,812 A * 7/1973 Kluge et al. ..... 200/574
3,956,606 A * 5/1976 Reiter ..... 200/332.1
5,041,705 A * 8/1991 Piccoli ..... 200/543
5,587,569 A * 12/1996 Mohtasham ..... 200/17 R
5,665,947 A * 9/1997 Falcon ..... 200/61.18
5,821,484 A * 10/1998 Schulze et al. ..... 200/17 R
5,977,500 A * 11/1999 Mohtasham ..... 200/574
6,037,551 A * 3/2000 Fukui et al. ..... 200/574 X

FOREIGN PATENT DOCUMENTS

| | | | |
|---|---|---|---|
| DE | 2935420 | * | 3/1980 |
| EP | 581660 | * | 2/1994 |
| WO | WO 97/20334 | * | 6/1997 |

* cited by examiner

*Primary Examiner*—J. R. Scott
(74) *Attorney, Agent, or Firm*—Pillsbury Winthrop LLP

(57) ABSTRACT

A switch mechanism for use in for example a rope switch. The mechanism comprises a switch which is actuable to switch between first and second conditions, for example to turn on and off kinetic machinery. A cam follower actuates the switch, the cam follower bearing against the surface of a rotatably mounted cam. An actuator member is displaceable relative the cam and a linkage is provided between the actuator member and the cam such that displacement of the actuator member from a predetermined position causes the cam to rotate and actuate the switch. The linkage comprises a lever mounted on a pivot that is displaced with the actuator member, the lever co-operating with a surface of a stationary cam such that displacement of the actuator member causes the lever to pivot and rotate the rotatable cam.

12 Claims, 9 Drawing Sheets

SWITCH ASSEMBLIES

BACKGROUND OF THE INVENTION

1. Field of the Invention

This invention relates to switch assemblies and more particularly, but not exclusively, to rope operated switch assemblies used to control the power supply to kinetic machinery.

Known rope operated switch assemblies comprise a safety switch adapted to be fitted in proximity to a machine. and an actuator connected to the switch and operable by a rope to turn off the electrical power supply when the rope is pulled or slackened.

2. Discussion of the Related Art

Safety switches of this type have a housing in which are situated normally-open contacts, one set fixed, the other movable and carried by an axially-movable plunger spring-loaded to maintain the sets of contacts closed and the power supply consequently on.

The axially-movable plunger bears against a rotatable cam of a cam arrangement normally disposed to maintain the cam in a position such that the plunger is in a power supply ON position but which is operable by the rope to cause cam rotation and axial movement of the plunger to a power supply OFF position.

In one particular example the rope is connected in axial alignment to a shaft extending into the housing. The rope is connected to the shaft in tension so that the shaft is held against a biasing force provided by a shaft spring. If the rope tension is relaxed (e.g. by cutting it) the biasing force moves the shaft in a first axial direction and if the rope tension is increased (e.g. by pulling it) the shaft moves in a second axial direction with the rope. The shaft has a circumferential latch adjacent an undercut at a certain position along its length. The latch is biased in a direction perpendicular to the longitudinal axis of the shaft. The shaft carries a loop that engages a pin on the cam so that axial movement of the shaft in either direction will drive the cam and operate the plunger to a power supply OFF position. If the rope is cut, the shaft spring maintains the shaft in a switch OFF position. If the rope is pulled but subsequently released, the shaft is maintained in a switch OFF position by the latch which has engaged with the undercut. This prevents the power supply being turned on again unless the switch is reset.

These known switch assemblies operate satisfactorily if the rope is cut, but suffer from the disadvantage that if the rope tension is increased slightly it may be sufficient to turn the power supply off but not sufficient for the latch to operate so as to prevent a subsequent slight reduction in rope tension turning the power on again. Similarly, if the rope tension is decreased slightly it may be sufficient to turn the power supply off but a subsequent slight increase in tension could turn the power supply on again. Thus dangerous conditions can arise if for example a machine operator has been injured and has pulled the rope to switch off the machinery but it too weak or is otherwise unable to pull on the rope with sufficient force to engage the latch.

BRIEF SUMMARY OF THE INVENTION

It is an object of the present invention to provide a switch assembly in which such disadvantages are obviated or mitigated.

According to the present invention there is provided a switch mechanism comprising a switch which is actuable to switch between first and second conditions, a cam follower movement of which actuates the switch, a rotatably mounted cam against a surface of which the cam follower bears, an actuator member which is displaceable relative to the cam, and a linkage between the actuator member and cam arranged such that displacement of the actuator member from a predetermined position causes the cam to rotate and actuate the switch, wherein the linkage comprises a lever mounted on a pivot that is displaced with the actuator member, the lever co-operating with a surface of a stationary cam such that displacement of the actuator member causes the lever to pivot and rotate the rotatable cam.

The lever arrangement in accordance with the present invention makes it possible for a relatively small movement of an actuator shaft or the like to cause a relatively large angular movement of the rotatable cam. Thus the device is particularly sensitive which is of real importance in the case of a rope-operated switch.

The actuator member may be a shaft that extends into a housing, the lever being pivotally supported on a body connected to the shaft and the stationary cam being defined by an internal wall of the housing.

Preferably the rotatable cam is rotatable from a datum position in which the switch assumes the first condition to at least one displaced position in which the switch assumes the second condition. and means are provided to bias the cam away from the datum position once the cam has been rotated by the lever. The biasing means preferably comprises a first latch member pivotally supported adjacent the rotatable cam, a second latch member bearing against the cam, and a spring arranged to bias the first and second latch members apart, the spring biasing force being directed in a direction which intersects the axis of rotation of the rotatable cam when the cam is in the datum position. The actuator member may extend through an aperture in at least one of the latch members, and the first latch member may be pivoted about an arcuate surface against which it is biased by the spring. Means may be provided to push the first latch member to a position in which the spring biasing force is directed in a direction to one side of the axis of rotation of the rotatable cam and thereby to cause the cam to rotate.

Preferably the lever defines a recess on one side which receives the stationary cam and a pair of arms on the opposite side to the recess which arms project on opposite sides of an abutment member forming part of the rotatable cam when the actuator member is in the predetermined position, one arm being displaced into contact with the abutment member when the actuator member is displaced in a first direction from the predetermined position, and the other arm being displaced into contact with the abutment member when the actuator member is displaced in the opposite direction to the first direction. The lever arms may be disposed such that rotation of the cam to actuate the switch between the first and second conditions is obstructed unless the actuator member is in the predetermined position.

In an alternative arrangement, the lever may define a recess on one side which receives the stationary cam and a single arm on the opposite side to the recess, the arm projecting to one side of an abutment member forming part of the rotatable cam when the actuator is in the predetermined position, and being displaced into contact with the abutment member so as to rotate the cam when the actuator member is displaced in a first direction from the predetermined position. And the actuator member supporting an abutment member which is displaced into contact with the biasing means so as to rotate the cam when the actuator member is displaced in a second direction from the predetermined position. Displacement of the actuator member in the first or the second direction may rotate the cam in the same direction.

BRIEF DESCRIPTION OF THE DRAWINGS

A specific embodiment of the present invention will now be described, by way of example only, with reference to the accompanying drawings, in which:

FIGS. 7 and 8 being sections on the lines 7—7 and 8—8 as shown in FIG. 6;

DETAILED DESCRIPTION

Figure 1:
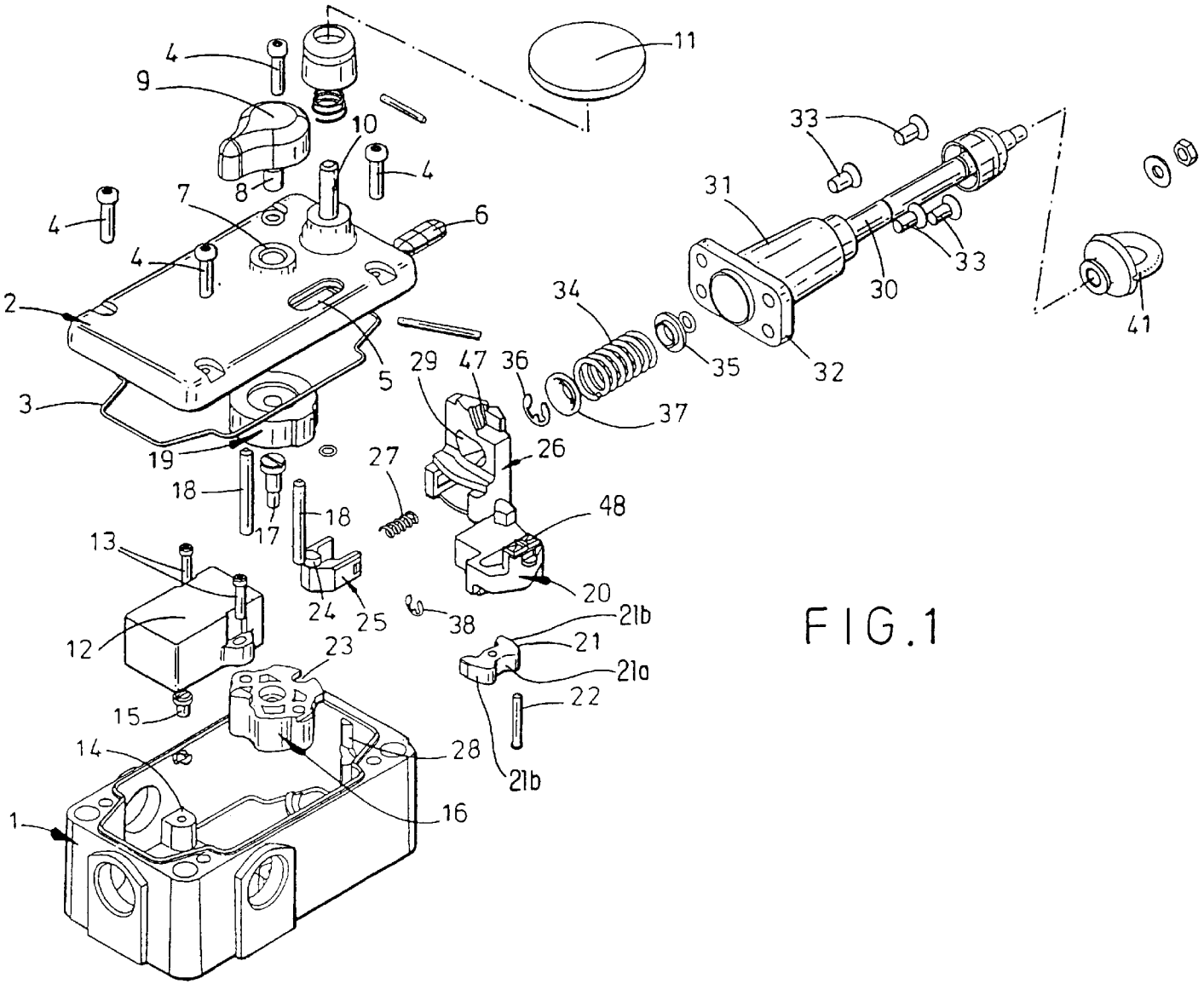
FIG. 1 is an exploded view of a switch assembly in accordance with the present invention.

Referring to FIG. 1, the illustrated switch assembly comprises a box casting 1 having an open top that is normally closed by a lid 2. A resilient seal is received between the box 1 and lid 2, the lid being secured by bolts 4. The box defines a window 5 closed by a transparent lens 6, a first bore 7 which receives a shaft 8 connected to a reset lever 9. And a second bore which receives a shaft 10 coupled to a stop button 11.

A three hole circuit breaker assembly 12 is secured within the box 1 by bolts 13. Wires (not shown) may be fed into the box through one of the illustrated ports to the circuit breaker assembly 12 and the circuit breaker assembly may be earthed by connecting a wire to a formation 14 within the box by means of a screw 15 and an associated washer.

An actuator cam 16 is secured by a pin 17 adjacent one end of the circuit breaker assembly 12. The actuator cam 16 carries two drive pins 18 which extend into a lid cam 19. The lid cam 19 is fixed to rotate with the shaft 8 of the reset lever 9. A lever support 20 is positioned between the actuator cam 16 and the lid cam 19 and between the drive pins 18. A lever 21 is mounted by a pin 22 on the lever support 20, the lever co-operating with a cam surface (not shown in FIG. 1) defined by a formation cast into the inside wall of the box 1. The lever 21 defines a recess 21*a* and two arms 21*b*.

The actuator cam 16 defines a slot 23 which receives a short pin 24 extending upwards from the body of an inner spring support 25. The inner spring support 25 is slidably received in a lower portion of an outer spring support 26, a spring 27 being compressed between the spring supports 25 and 26 so as to bias them apart. The outer spring support 26 bears against an arcuate rib 28 defined on the inside of one of the walls of the box 1.

The outer spring support 26 defines an aperture 29 through which an actuator shaft 30 extends. The actuator shaft 30 extends through a spring housing 31 defining a flange 32 which is mounted on the end wall of the box 1 by bolts 33. A spring 34 is arranged around the shaft 30 between a sleeve 35 which abuts the spring housing 31 and a circlip 36 and circlip cover 37 which are fixed in position along the length of the shaft 30. The spring 36 thus biases the shaft 30 into the box 1. The end of the shaft 30 inside the box 1 extends through a bore in the lever support 20 and is retained against withdrawal from that bore by a circlip 38. Appropriate O-ring and bellow seals are provided around the shafts 8, 10 and 30 to ensure that the circuit breaker 12 is located within a sealed enclosure.

Figure 2:
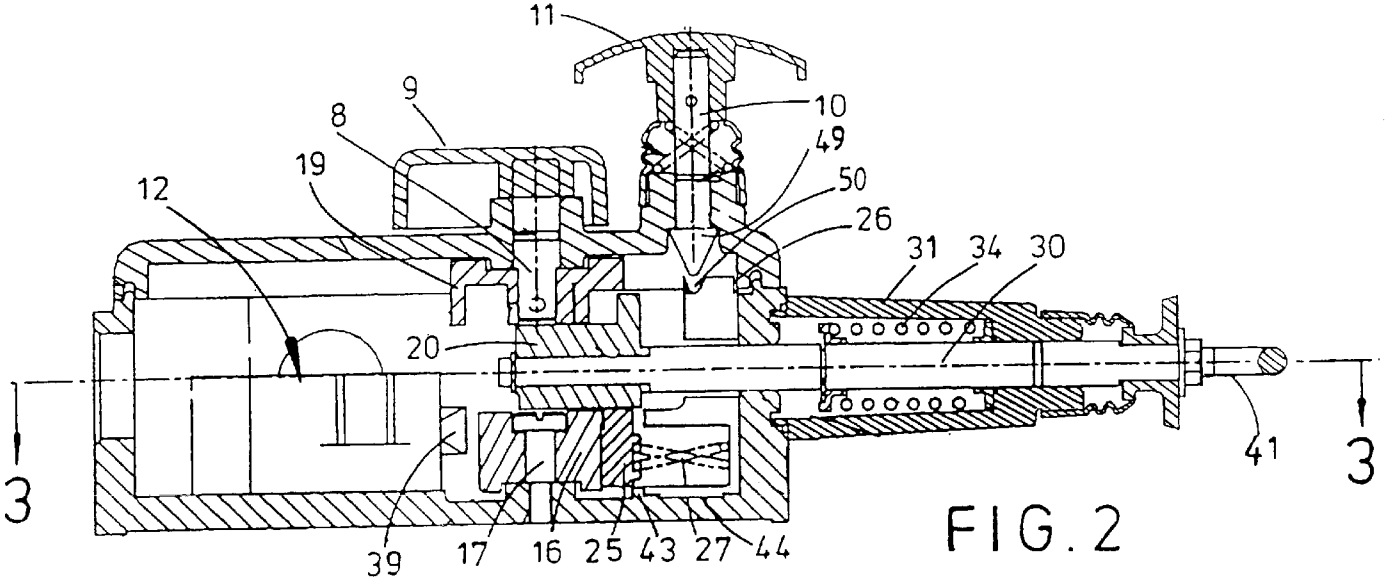
FIG. 2 is a part-sectional view through the switch assembly of FIG. 1.
Figure 3:
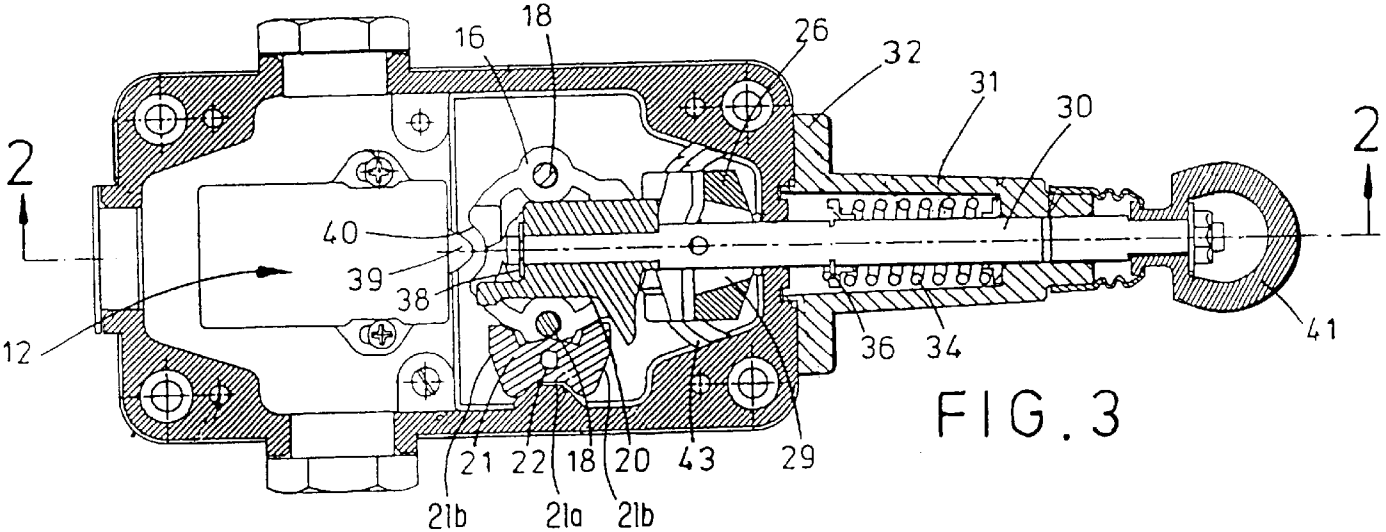
FIG. 3 is a section on the line 3—3 of FIG. 2 and indicates the section of FIG. 2 by the lines 2—2.
Figure 4:
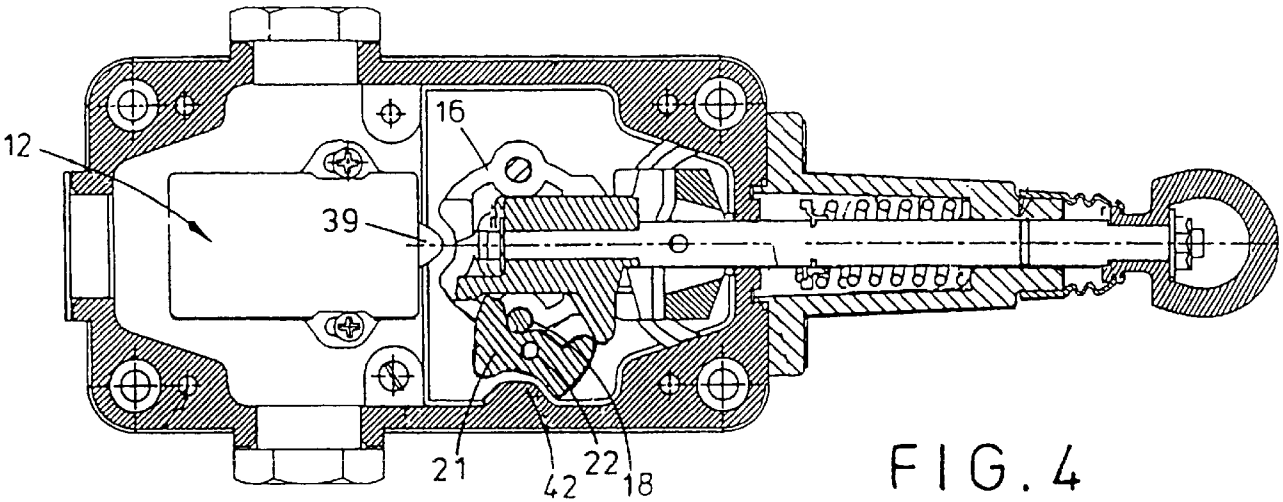
FIG. 4 is a view similar to that of FIG. 3 showing the switch assembly after an actuator shaft has been displaced in a first direction.

Referring to FIGS. 2 and 3, it will be seen that the circuit breaker assembly 12 supports a cam follower in the form of a plunger 39 which faces a recess 40 defined in the actuator cam 16. For the purposes of illustration the plunger 39 is shown spaced from the actuator cam but in practice the plunger will be biased towards the right in FIG. 3 so as to bear against the cam. In FIGS. 2 and 3, the components are shown in the positions they adopt when a ring 41 attached to the shaft 30 has been connected to a rope that has been appropriately tensioned to hold the shaft 30 and the lever support 20 in an intermediate position. In that intermediate position. The W-shaped lever 21 is symmetrical about a plane through the axis of the pins 18. With the lever 21 in that position, the actuator cam 16 can be rotated in either direction without the movement of the lower pin 18 (in FIG. 3) being obstructed. If the rope tension is increased however the shaft 30 is displaced to the right. As a result the lever support 20 is also displaced to the right, carrying with it the pin 22 and the lever 21. Such a displacement is shown in FIG. 4. The side of the lever 21 remote from the actuator cam bears against a vertically extending rib 42 moulded into the wall of the box 1. The rib 42 acts as a cam against which the lever 21 bears and as a result as the pin 22 moves to the right the lever 21 is turned around the pin 22 in a clockwise direction until it bears against the adjacent pin 18. If the shaft 30 is moved further to the right than the position shown in FIG. 4 the lever 21 forces the pin 18 to the right, causing the actuator cam 16 to rotate in the anticlockwise direction in FIG. 4. As a result the plunger 39 is pushed into the body of the circuit breaker 12, switching the contacts within the circuit breaker 12

Figure 5:
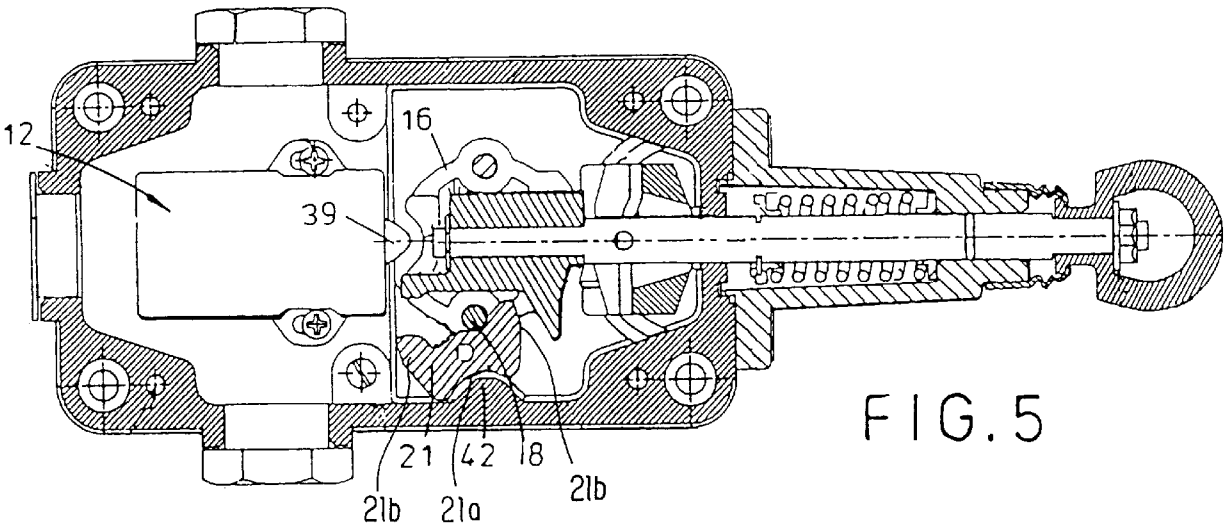
FIG. 5 is a similar view to that of FIG. 3 showing the actuator shaft displaced in a second direction.
Figure 11:
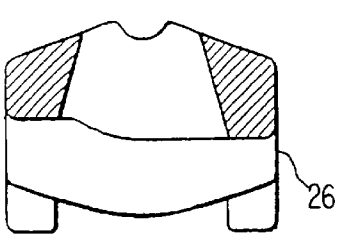
FIGS. 9 to 13 illustrate an outer spring support incorporated in the switch assembly of FIG. 1, FIGS. 10 and 13 being views on the lines 10—10 and 13—13 of FIG. 9 and FIGS. 11 and 12 being sections on the lines 11—11 and 12—12 of FIG. 10.
Figure 13:
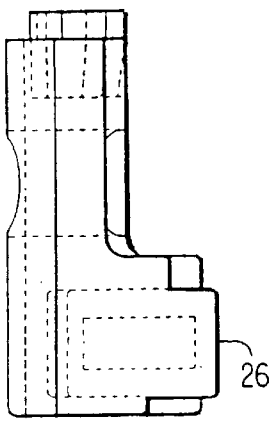
Figure 9:
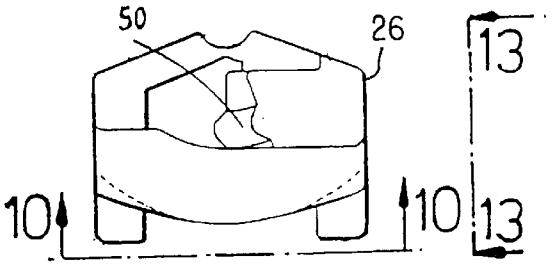
Figure 10:
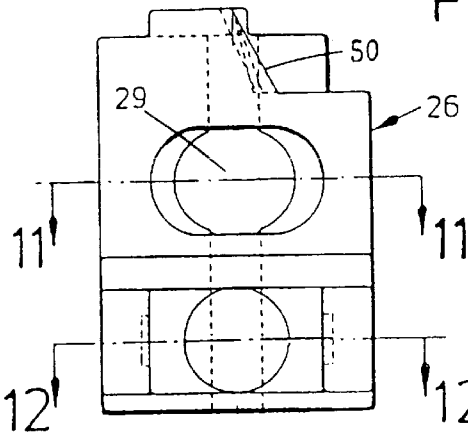
Figure 12:
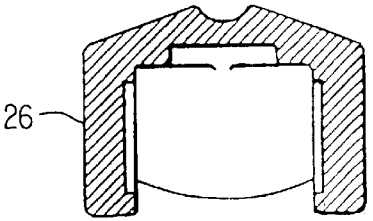
Figure 6:
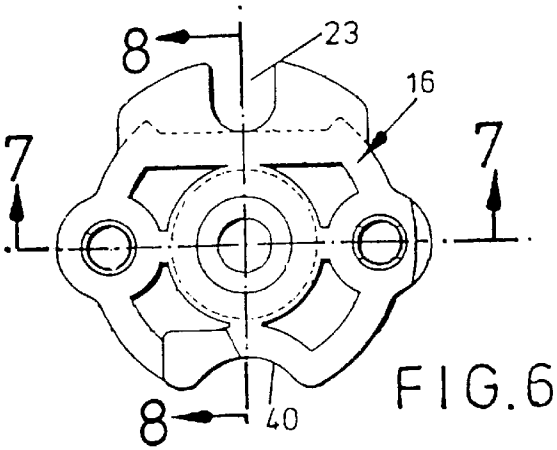
FIGS. 6, 7 and 8 show an actuator cam incorporated in the switch assembly of FIG. 1.
Figure 7:
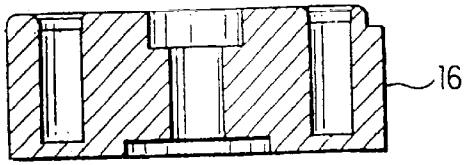
Figure 8:
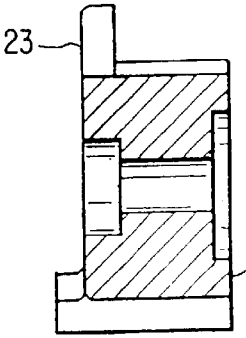

If the tension of the rope controlling the position of the shaft 30 reduces, the shaft 30 will move to the left in FIG. 3. As a result the lever 21 will pivot in the anticlockwise direction as shown in FIG. 5 until it bears on the pin 18. Further relaxation of the tension applied to the shaft 30 will cause further rotation of the lever 21, forcing the pin 18 to the left in FIG. 5 and the consequential clockwise rotation of the actuator cam 16. This is turn once again causes the plunger 39 to be pushed into the body of the circuit breaker 12.

Once the actuator cam 16 has been displaced from the position shown in FIG. 3, the spring 27 and the inner and outer spring supports 25 and 26 cause the actuator cam 16 to move rapidly with a snap-action. This can best be appreciated by reference to FIGS. 17 to 20.

Figure 17:
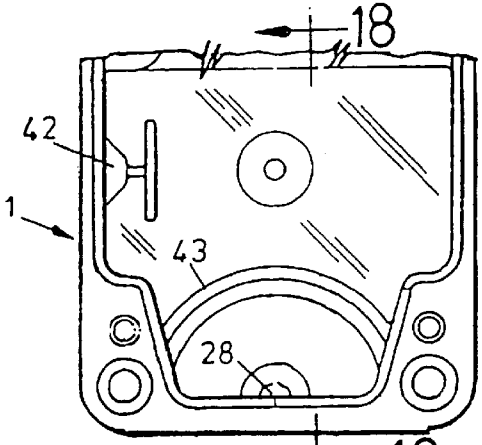
FIG. 17 is a plan view of one end of a box casting incorporated in the switch assembly of FIG. 1.
Figure 18:
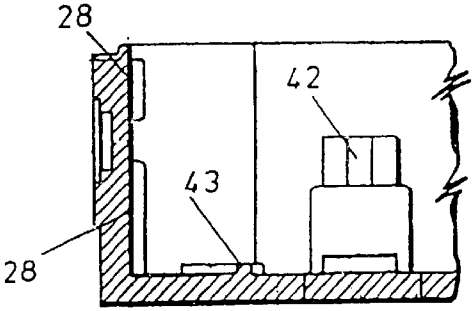
FIG. 18 is a section on the lines 18—18 of FIG. 17.
Figure 14:
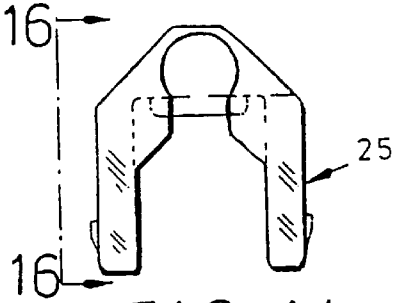
FIGS. 14 to 16 illustrate an inner spring support incorporated in the switch assembly of FIG. 1, FIGS. 15 and 16 being views on the lines 15—15 and 16—16 of FIG. 14.
Figure 15:
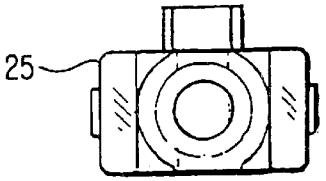
Figure 16:
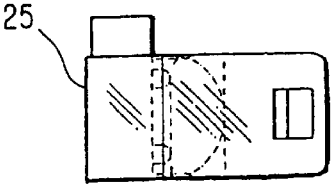
Figure 21:
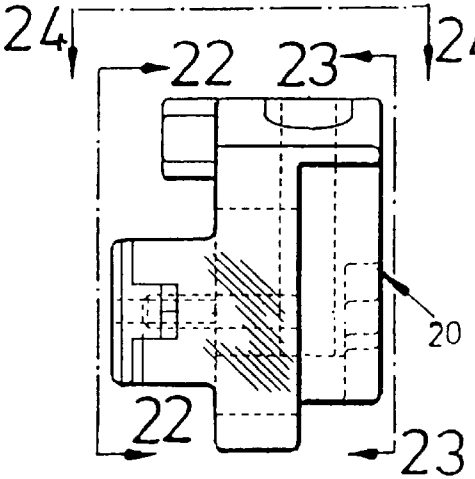
FIGS. 21 to 24 illustrate a lever support incorporated in the switch assembly of FIG. 1, FIGS. 22, 23 and 24 being views on the lines 22—22, 23—23 and 24—24 of FIG. 21.
Figure 23:
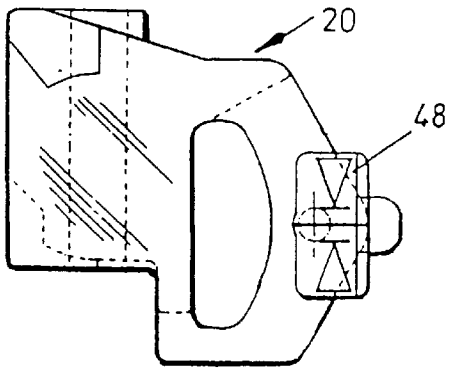
Figure 24:
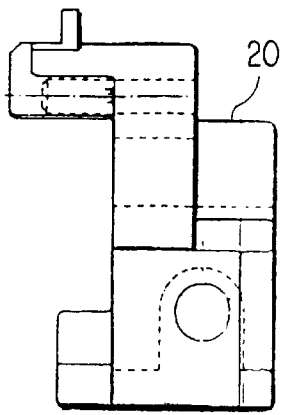
Figure 22:
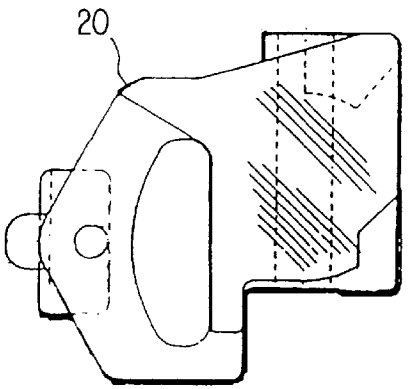
Figure 25:
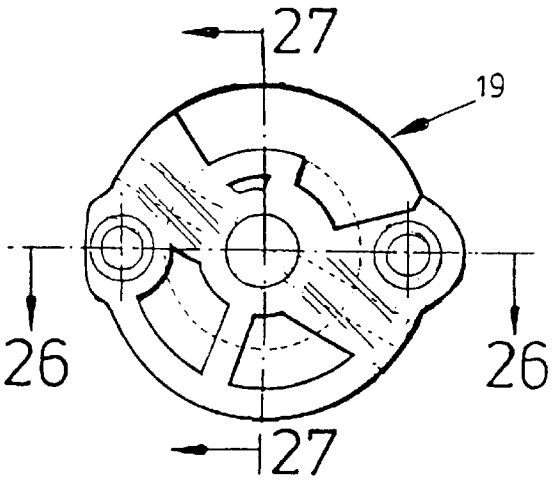
FIGS. 25 to 27 illustrate a lid cam incorporated in the assembly of FIG. 1, FIGS. 26 and 27 being sections on the lines 26—26 and 27—27 of FIG. 25.
Figure 26:
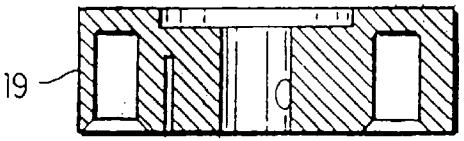
Figure 27:
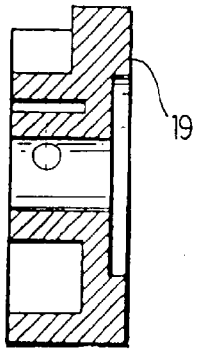

FIGS. 17 and 18 are respectively plan and sectional views through the end of the box 1 which receives the outer spring support 26. These Figures show the vertically extending rib 28 which is of semi-circular section and extends above and below an opening in the box through which the shaft 30 extends. In addition, an arcuate upstanding rib 43 is formed in the base of the box, the rib 43 retaining a lower portion 44 of the outer spring support 26 as best seen from FIG. 2. The outer spring support 26 is thus rotatable along an arcuate path defined between the rib 28 and the rib 43.

Figure 19:
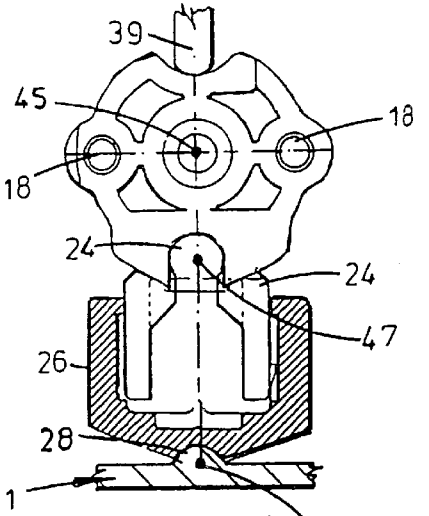
FIGS. 19 and 20 respectively illustrate the relative positions of the actuator cam and inner and outer spring supports for a first and second switching condition of the assembly of FIG. 1.
Figure 20:
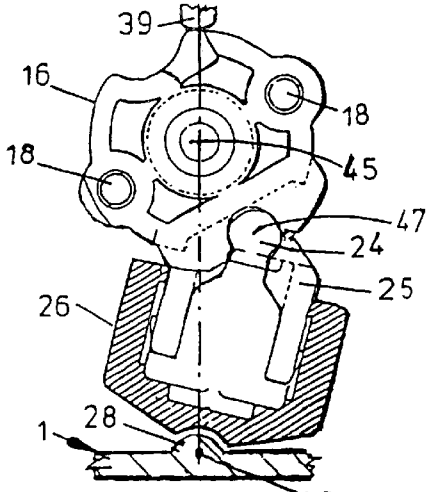

Referring to FIGS. 19 and 20, the outer lines of the actuator cam 16, inner spring support 25 and outer sprint support 26 are shown in the configuration corresponding to FIG. 2 (FIG. 19) and the configuration corresponding to displacement of the actuator cam as a result of the shaft 30 being pulled out of the box 1 (an even more extreme condition than that illustrated in FIG. 4). The point 45 represents the fixed axis about which the actuator cam 16 is rotatable. The point 46 represents the position of the axis about which the outer spring support 26 can turn, and the point 47 represents the position of the axis about which the inner spring support 25 can turn relative to the actuator cam 16. In the relative position shown in FIG. 19, the points 45, 46 and 47 are aligned. Hence the spring force tending to push the spring supports 25 and 26 apart does not apply any torque to the actuator cam 16. As soon as the actuator cam 16 is displaced from the position shown in FIG. 19 however the point 47 is no longer aligned with the points 45 and 46 and as a result the lever supports 25 and 26 will move apart, thereby causing the actuator cam 16 to rotate away from its initial position as represented in FIG. 19. The required snap-action is thus obtained.

Referring to FIGS. 4 and 5, it will be seen that once the lever 21 has been displaced from the position shown in FIG. 3, one or other of the two arms 21*b* defined by the lever 21 extends across the arcuate path which must be followed by the adjacent pin 18 if the actuator cam 16 is to be returned to the position shown in FIG. 3. Accordingly if for example the rope controlling the axial position of the shaft 30 is severed and the shaft therefore moves to the left in FIG. 2, the lever 21 will push the actuator cam 16 in the clockwise direction and will prevent the return of the actuator camn 16 to the position shown in FIG. 2 until the lever 21 has been returned to its starting position as shown in FIG. 2. Thus any equipment energised via the circuit breaker 12 will be disabled when the rope is severed and cannot be re-enabled until the shaft 30 has been returned to the position shown in FIG. 3. Once the shaft 30 has been returned to the position shown in FIG. 3, an operator can simply rotate the reset lever 9 to thereby rotate the lid cam 19. The lid cam is engaged by the pins 18 and accordingly rotation of that cam also causes rotation of the actuator cam 16.

The position of the lever support 20 can be inspected through the lens 6 and to make this easier the lever support 20 may support an appropriate pattern 48 on a surface extending beneath the lens 6. Therefore the condition of the circuit breaker can be inspected readily.

The stop button 11 may be depressed to move the actuator cam 16 from the position shown in FIG. 3. The stop button shaft 10 has a pointed tip 49 (FIG. 2) which is located immediately above a ramp 50 defined in the outer spring support 26. Pushing down on the button 11 drives the pin 10 against the ramp 50, causing the outer spring support 26 to turn about the vertical rib 28. As soon as a turning movement has been initiated the snap action mechanism ensures a rapid and substantial rotation of the actuator cam 16.

In the embodiment of FIGS. 1 to 27, the cam is rotated in one direction when the tension in the rope exceeds a predetermined limit and is rotated in the opposite direction when the tension in the rope is less than a predetermined limit. Alternative arrangements are possible however and one such alternative arrangement will now be described with reference to FIGS. 28 to 38.

Figure 28:
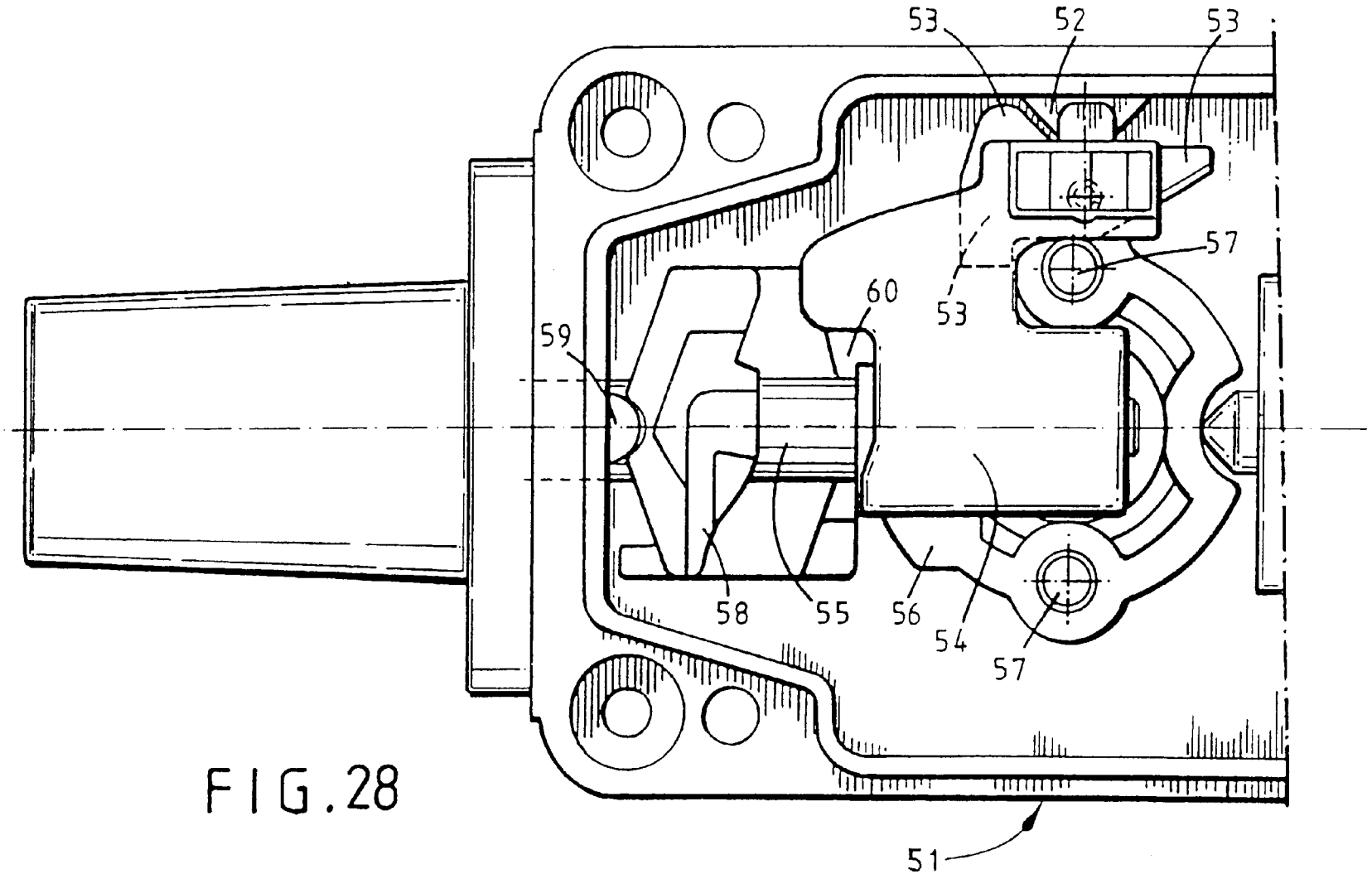
FIG. 28 is a plan view of internal components of a further embodiment of the present invention.
Figure 31:
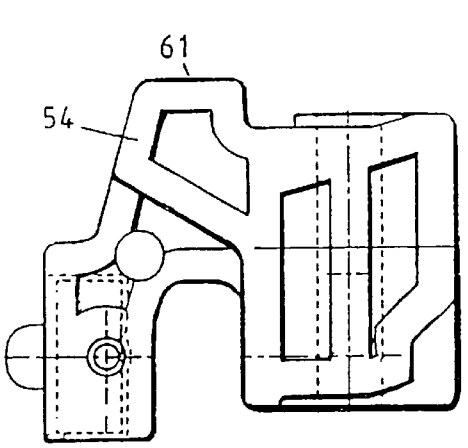
FIG. 31 is a view on lines 31—31 of FIG. 30.
Figure 34:
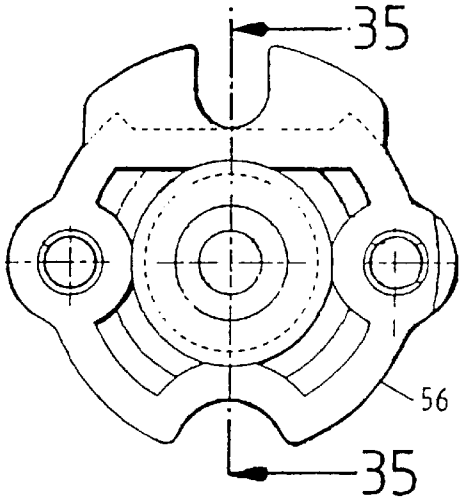
FIG. 34 is a top view of a cam incorporated in the embodiment of FIG. 28.
Figure 30:
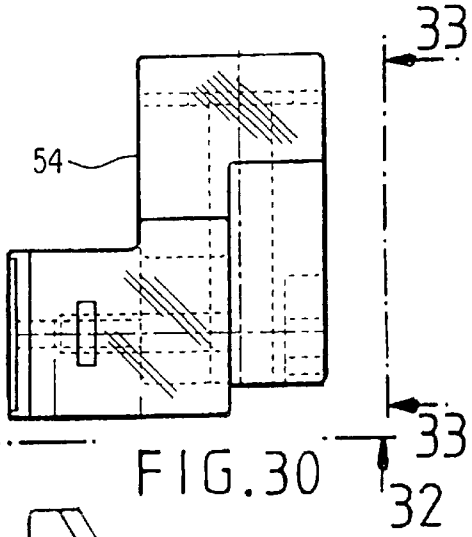
FIG. 30 is a view on lines 30—30 of FIG. 29.
Figure 33:
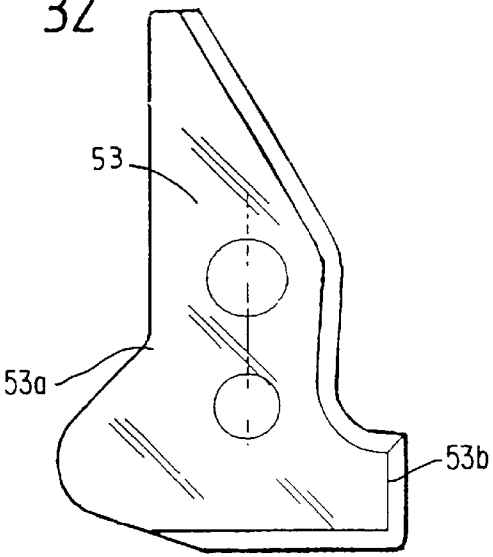
FIG. 33 is a plan view of a lever incorporated in the embodiment of FIG. 28.
Figure 29:
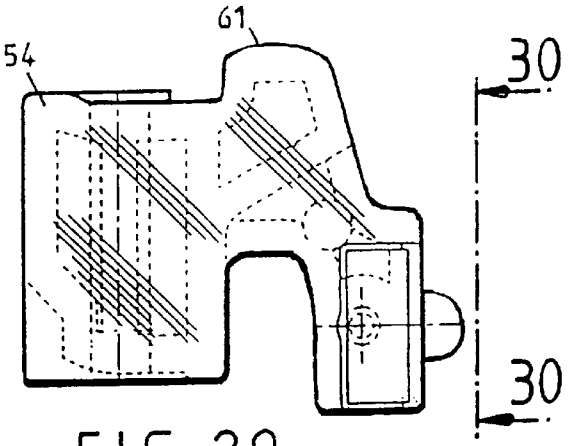
FIG. 29 is a plan view of a lever support incorporated in the embodiment of FIG. 28.
Figure 32:
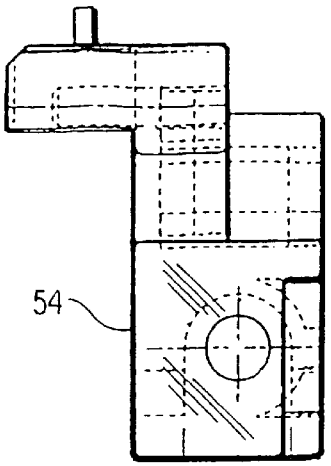
FIG. 32 is a view on lines 32—32 of FIG. 30.
Figure 38:
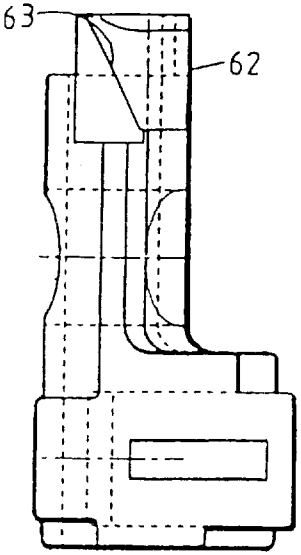
FIG. 38 is a view on the lines 38—38 of FIG. 37.
Figure 37:
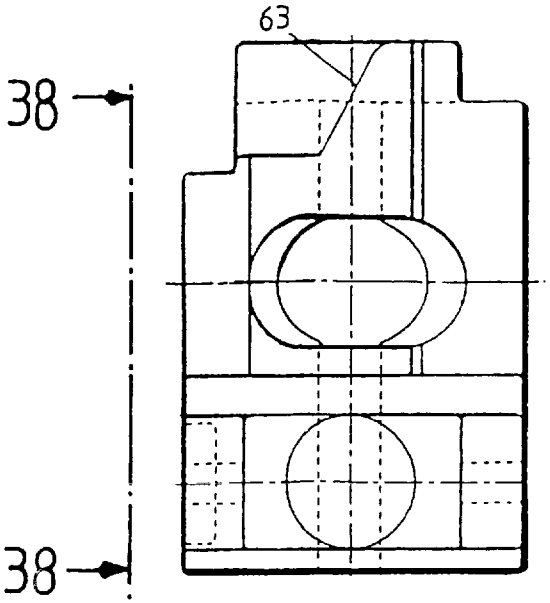
FIG. 37 is a view on the lines 37—37 of FIG. 36
Figure 36:
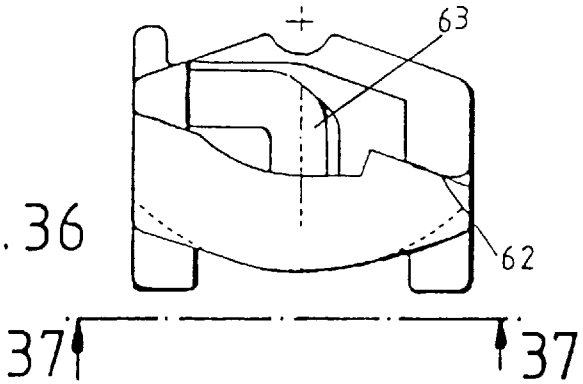
FIG. 36 is a top view of an outer spring support incorporated in the embodiment of FIG. 28.
Figure 35:
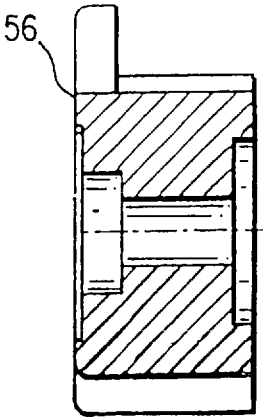
FIG. 35 is a section through FIG. 34 on line 35—35.

Referring to FIG. 28, it will be noted that this embodiment bears striking resemblances to the embodiment of FIGS. 1 to 27. In particular, the illustrated rope switch comprises a casing 51 defining a cam 52 against which a lever 53 bears. The lever is pivotally mounted on a pin extending downwards from a lever support 54 which is mounted on one end of a shaft 55. The lever support 54 is mounted above a cam 56 from which two pins 57 extend. An outer spring support 58 bears against and can rotate about a cam 59 defined by an inside wall of the casing. The outer spring support 58 receives an inner spring support 60 which engages in a recess in the cam 56. The inner spring support 60 is identical in shape and function to that illustrated in FIG. 14, but only portions of it are visible in FIG. 28 as it is largely covered by the outer spring support 58 and the lever support 54. A spring (not shown) biases supports 58 and 60 apart.

In the case of the embodiment of FIGS. 1 to 27, if the shaft 30 is displaced in either direction from the position shown in FIG. 28. the cam is caused to rotate in the corresponding direction so as to actuate the switch into an OFF condition. In the case of the embodiments of FIGS. 28 to 38 however regardless of the direction of displacement of the shaft 55 the cam 56 will always rotate in the same direction, that is the clockwise direction as shown in FIG. 28.

If the shaft 55 is displaced to the right in FIG. 28, the lever 53 will be caused to rotate in an anticlockwise direction as a result of engagement between a recess 53*a* defined by the lever 53 and with the cam 52.

An arm 3*b* defined by the lever 53 will engage the uppermost pin 5, pushing the cam 56 in the clockwise direction. A very small displacement of the cam 56 will cause the over centre mechanism defined by the interengagement between the inner and outer spring supports and the cam 56 to apply a clockwise torque to the cam 56 which will as a result rapidly rotate to a contacts OFF position.

If the shaft 55 is displaced to the left in FIG. 28. an abutment surface 61 will bear against a surface 62 defined by the outer spring support 58. As a result the outer spring support will rotate in an anticlockwise direction and the inner spring support 60 will rotate with it, causing thereby a clockwise rotation of the cam 56. Again, as soon as a displacement of the cam 56 has been initiated the over centre mechanism will rapidly rotate the cam to a contacts OFF position.

Thus if a rope attached to the switch becomes too slack or too tight the switch will automatically assume a safe position. In an emergency, the switch can be turned off by pressing against a button (not shown) similar to the button 11 of the embodiment of FIGS. 1 to 27. Pressing the button drives a pointed shaft (not shown) into contact with a ramp 63 defined in an upper portion of the outer spring support 58. This causes the outer spring support to turn in an anticlockwise direction, again forcing the cam 56 to turn in a clockwise direction towards a contacts OFF position.

Although the components of the embodiment illustrated in figs. 28 to 38 have not been described in such great detail as those of the embodiment of FIG. 1 to 27, it is believed that the description provided is sufficient given the similarities between the method of the two embodiments.

What is claimed is:

1. A switch mechanism comprising a switch which is actuable to switch between first and second conditions, a plunger, movement of which actuates the switch, a rotatably mounted cam against a surface of which the plunger bears, an actuator member which is displaceable relative to the cam, and a linkage between the actuator member and the cam arranged such that displacement of the actuator member from a predetermined position causes the cam to rotate and actuate the switch, wherein the linkage comprises a lever mounted on a pivot that is displaced with the actuator member, the lever co-operating with a surface of a vertically extending rib such that displacement of the actuator member causes the lever to pivot and rotate the rotatable cam.

2. A switch mechanism according to claim 1, wherein the actuator member is a shaft that extends into a housing, the lever being pivotally supported on a body connected to the shaft and the vertically extending rib being defined by an internal wall of the housing.

3. A switch mechanism according to claim 1, wherein the rotatable cam is rotatable from a datum position in which the switch assumes the first condition to at least one displaced position in which the switch assumes the second condition, and means are provided to bias the cam away from the datum position once the cam has been rotated by the lever.

4. A switch mechanism according to claim 3, wherein the biasing means comprise an outer spring support pivotally supported adjacent the rotatable cam, an inner spring support bearing against the cam, and a spring arranged to bias the outer and inner spring supports apart, a spring biasing force being directed in a direction which intersects an axis of rotation of the rotatable cam when the cam is in the datum position.

5. A switch mechanism according to claim 4, wherein the actuator member extends through an aperture in at least one of the spring supports.

6. A switch mechanism according to claim 4, wherein the outer spring support is pivoted about an arcuate surface against which it is biased by the spring.

7. A switch mechanism according to claim 4, wherein means are provided to push the outer spring support to a position in which the spring biasing force is directed in a direction to one side of the axis of rotation of the rotatable cam and thereby to cause the cam to rotate.

8. A switch mechanism according to claim 1, wherein the lever defines a recess on one side which receives the vertically extending rib and a pair of arms on the opposite side to the recess, the arms projecting on opposite sides of an abutment member forming part of the rotatable cam when the actuator member is in the predetermined position, one arm being displaced into contact with the abutment member when the actuator member is displaced in a first direction from the predetermined position, and the other arm being displaced into contact with the abutment member when the actuator member is displaced in the opposite direction to the first direction.

9. A switch mechanism according to claim 3, wherein the lever defines a recess on one side which receives the vertically extending rib and an arm on the opposite side of the recess, the arm projecting to one side of an abutment member forming part of the rotatable cam when the actuator member is in the predetermined position, and being displaced into contact with the abutment member so as to rotate the cam when the actuator member is displaced in a first direction from the predetermined position, and the actuator member supporting the abutment member which is displaced into contact with the biasing means so as to rotate the cam when the actuator member is displaced in a second direction from the predetermined position.

10. A switch mechanism according to claim 9, wherein displacement to the actuator member in the first or the second direction rotates the cam in the same direction.

11. A switch mechanism according to claim 1, further including a window relative to which the actuator member is displaceable and through which displacement of the actuator member can be inspected.

12. A switch mechanism according to claim 11, wherein a position of a support of the lever can be inspected through the window, the support of the lever carrying a pattern on a surface extending beneath the window.

* * * * *